US006988493B2

(12) United States Patent
Wenger et al.

(10) Patent No.: US 6,988,493 B2
(45) Date of Patent: Jan. 24, 2006

(54) METHOD FOR THE CONTROL OF AN INTERNAL COMBUSTION ENGINE COMBINED WITH A GAS-DYNAMIC PRESSURE WAVE MACHINE

(75) Inventors: Urs Wenger, Langenthal (CH); Roger Martin, Othmarsingen (CH)

(73) Assignee: Swissauto Engineering S.A., (CH)

( * ) Notice: Subject to any disclaimer, the term of this patent is extended or adjusted under 35 U.S.C. 154(b) by 180 days.

(21) Appl. No.: 10/460,454

(22) Filed: Jun. 12, 2003

(65) Prior Publication Data

US 2004/0003802 A1 Jan. 8, 2004

(30) Foreign Application Priority Data

Jun. 28, 2002 (EP) ..... 02405544

(51) Int. Cl.

| | |
|---|---|
| ***F01N 3/20*** | (2006.01) |
| ***F02B 33/00*** | (2006.01) |
| ***F02B 33/42*** | (2006.01) |
| ***F04F 11/02*** | (2006.01) |

(52) U.S. Cl. ..... 123/559.2; 60/600; 60/602; 60/605.2; 417/64

(58) Field of Classification Search ..... 123/559.2; 417/64; 60/600, 602, 605.2
See application file for complete search history.

(56) References Cited

U.S. PATENT DOCUMENTS

| | | | | |
|---|---|---|---|---|
| 2,800,120 | A * | 7/1957 | Gabo et al. | 123/559.2 |
| 3,011,487 | A * | 12/1961 | Berchtold | 123/559.2 |
| 3,811,796 | A * | 5/1974 | Coleman et al. | 417/64 |
| 3,958,899 | A * | 5/1976 | Coleman, Jr. et al. | 417/64 |
| 4,002,414 | A * | 1/1977 | Coleman, Jr. et al. | 417/64 |
| 4,309,972 | A * | 1/1982 | Vallance et al. | 123/559.2 |
| 4,398,868 | A * | 8/1983 | Komauer et al. | 417/64 |
| 4,488,532 | A * | 12/1984 | Mayer | 123/559.2 |
| 4,563,997 | A | 1/1986 | Aoki | 123/559.2 |
| 4,662,342 | A * | 5/1987 | Altmann et al. | 123/559.2 |
| 5,839,416 | A | 11/1998 | Kruiswyk et al. | 123/559.2 |
| 6,089,211 | A * | 7/2000 | Wenger | 123/559.2 |
| 6,314,951 | B1 * | 11/2001 | Wenger et al. | 123/559.2 |
| 6,325,054 | B1 * | 12/2001 | Wenger et al. | 123/559.2 |
| 6,367,460 | B1 * | 4/2002 | Wenger et al. | 123/559.2 |
| 6,439,209 | B1 * | 8/2002 | Wenger et al. | 123/559.2 |
| 2004/0003802 | A1 * | 1/2004 | Wenger et al. | 123/559.2 |

FOREIGN PATENT DOCUMENTS

| | | |
|---|---|---|
| JP | 05187247 | 7/1993 |
| JP | 07310556 | 11/1995 |
| WO | WO 99/11913 | 3/1999 |

* cited by examiner

OTHER PUBLICATIONS

R. Pfiffner et al., "Modeling and Model-based Control of Supercharged SI-Engines for Cars with Minimal Fuel Consumption" *Laboratory of International Combustion Engines and Combustion Technology, Swiss Federal Institute of Technology, Zurich, Switzerland.*

*Primary Examiner*—Sheldon J Richter
(74) *Attorney, Agent, or Firm*—Ostrolenk, Faber, Gerb & Soffen, LLP

(57) ABSTRACT

The method for the control of an internal combustion engine combined with a gas-dynamic pressure wave machine comprising a rotatable housing in order to control the process tuning over the entire performance field of the internal combustion engine as well as a variable width adjustment of the high pressure exhaust gas channel includes a certain control sequence of steps in a positive load variation and a certain control sequence of steps in a negative load variation.

9 Claims, 3 Drawing Sheets

METHOD FOR THE CONTROL OF AN INTERNAL COMBUSTION ENGINE COMBINED WITH A GAS-DYNAMIC PRESSURE WAVE MACHINE

FIELD OF THE INVENTION

The present invention refers to a method for the control of an internal combustion engine combined with a gas-dynamic pressure wave machine, said gas-dynamic pressure wave machine comprising a rotatable housing for controlling the process tuning over the entire performance field of the internal combustion engine, as well as a variable width adjustment of the high pressure exhaust gas channel or a variable gas pocket inlet.

PRIOR ART

A gas-dynamic pressure wave machine intended for supplying charge air to an internal combustion engine is known from WO 99/11913 to the applicant of the present invention. In particular, this reference discloses a rotatable air housing allowing to align the opening of one of the two high pressure channels with respect to the other openings of the other high pressure channel in order to control the process tuning over the entire performance field of the internal combustion engine, as well as a variable width adjustment of the high pressure exhaust gas channel and additional characteristic features.

Furthermore, from the publication *Modeling and Model-based Control of Supercharged SI Engines* of the Laboratory of Internal Combustion Engines of the Swiss Federal Institute of Technology Zurich, it is known to perform certain measurements on a gas-dynamic pressure wave machine based on the cited reference.

BACKGROUND OF THE INVENTION

The driving behavior may first be roughly divided into two stages, i.e. the acceleration and deceleration stage and the constant stage. In the first stage, two phases are distinguished, namely a positive load variation when the throttle is opened and a negative load variation when the speed is reduced or the throttle is closed. The second stage may be divided into three phases, namely the part-load phase, the no-load phase, and the constant full load phase.

The present invention particularly refers to the positive load variation when the throttle is opened and to the negative load variation when the throttle is closed or when reducing the speed with subsequent part-load behavior.

Tests have shown that the pressure wave supercharger may be damaged by exhaust gases reaching the air side of the gas-dynamic pressure wave machine due to incorrect operating speeds, an incorrect rotation of the housing, a closed throttle, an insufficient aperture or a failure of the width adjustment of the high pressure exhaust gas channel or of the variable gas pocket inlet, or an incorrect adjustment of the increase in efficiency by the application of a bypass duct between the fresh air and the exhaust gas section. Thus, for example, the bearings of the rotor may be damaged by collisions with the housings, and the operation of the engine may be disturbed by excessive exhaust gas recirculation and/or an insufficient charging pressure and/or an excessive charge air temperature.

SUMMARY OF THE INVENTION

It follows from these studies that with regard to the above-mentioned phases, a certain order in the control of the various operations is advantageous, and it is therefore an object of the present invention to avoid the disturbances or damages of the gas-dynamic pressure wave machine and to achieve an increased power as well as a reduced consumption. This object is attained by a method for the control of an internal combustion engine combined with a gas-dynamic pressure wave machine wherein a certain control sequence is followed in each area of the performance field, the operating speed and the housing of the gas-dynamic pressure wave machine being adjusted, in a positive load variation, by suitable means to the optimum position as stored in the performance field, and the variable width adjustment of the high pressure exhaust gas channel or the variable gas pocket inlet being adjusted for the charging pressure required according to the performance field of the engine; and the operating speed and the housing of the gas-dynamic pressure wave machine being adjusted, in a negative load variation, by suitable means to the optimum position as stored in the performance field, and the variable width adjustment of the high pressure exhaust gas channel or the variable gas pocket inlet being opened as far as possible in order to keep the pressure difference between the high pressure charge air and the high pressure exhaust gas as low as possible.

BRIEF DESCRIPTION OF THE DRAWINGS

The invention will be explained in more detail hereinafter with reference to drawings of exemplifying embodiments. The technical details of the internal combustion engine and of the gas-dynamic pressure wave machine are described in detail in WO 99/11913 and WO 99/11915 to the applicant of the present invention, which are expressly incorporated herein by reference in their entirety, corresponding to U.S. Pat. Nos. 6,439,209 and 6,314,951, respectively. Reference is made in particular to the characteristics relating to the rotation of the housing of the gas-dynamic pressure wave machine, especially of the air housing, for the tuning of the two high pressure exhaust gas channels, to the connecting duct between the high pressure charge air channel and the high pressure exhaust gas channel, and to the variable enlargement of the high pressure exhaust gas channel or the variable gas pocket inlet.

DETAILED DESCRIPTION OF THE INVENTION

Figure 1:
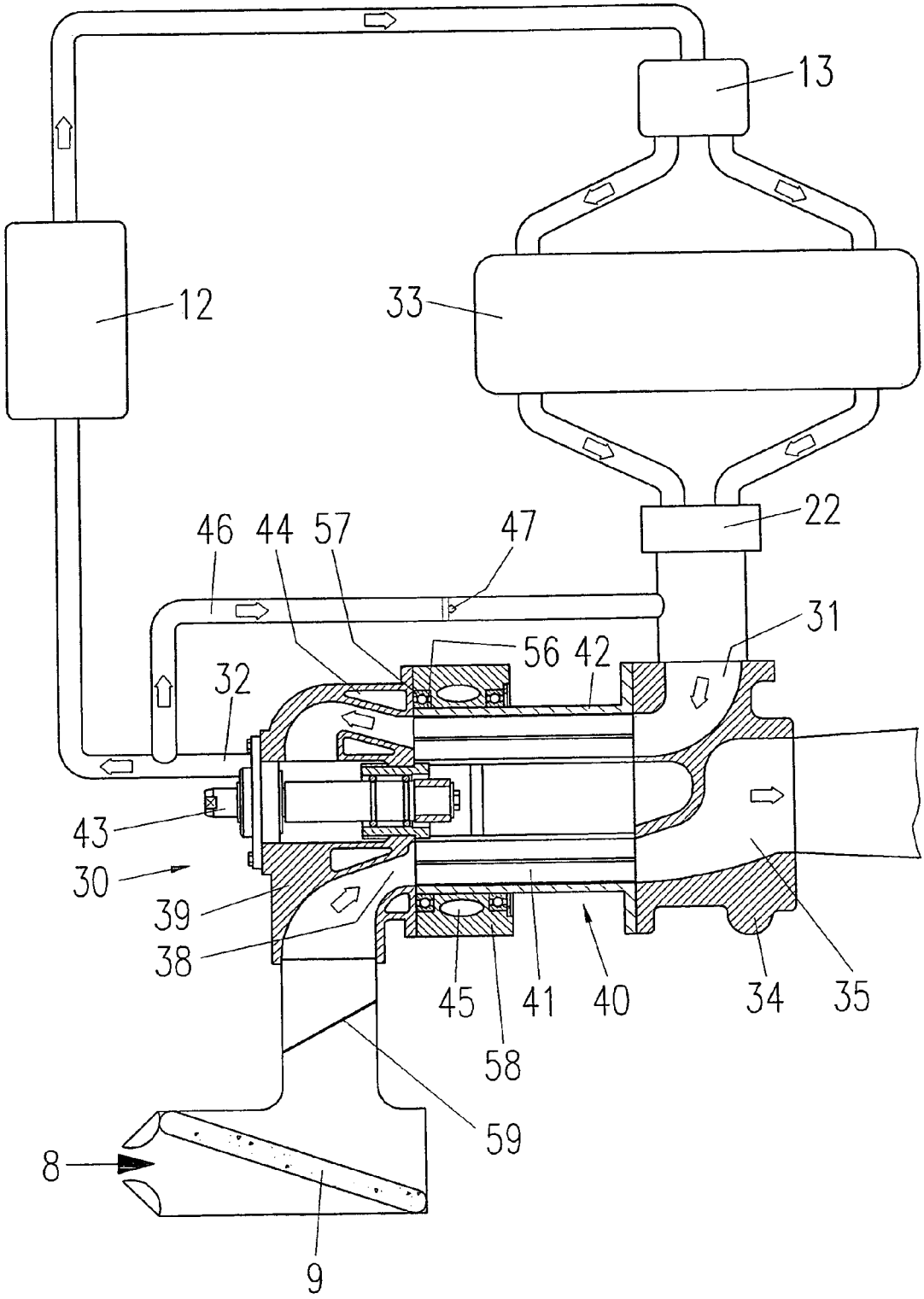
FIG. 1 shows a schematic and partially sectioned view of an exemplary embodiment of a gas-dynamic pressure wave machine.
Figure 2:
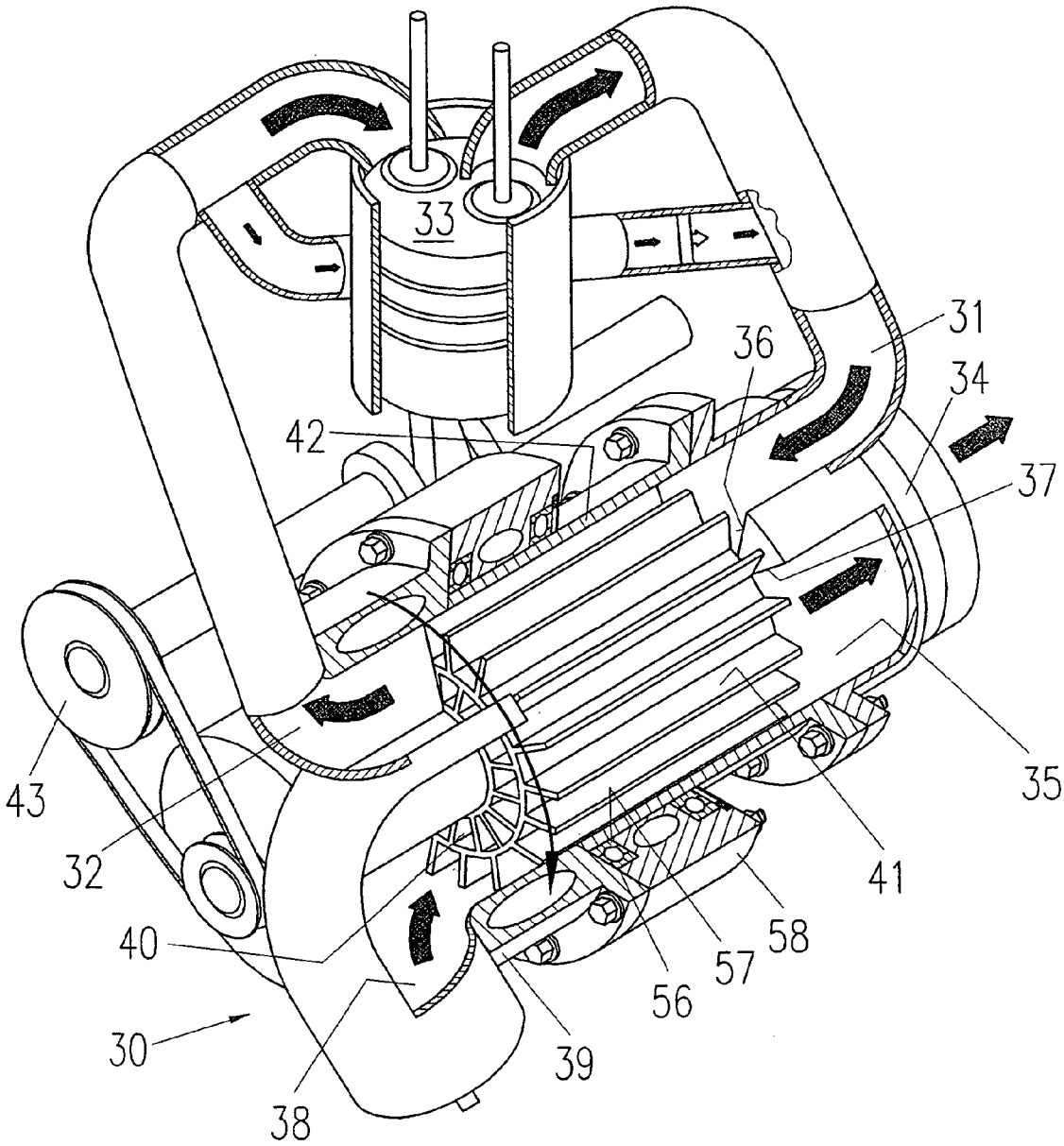
FIG. 2 shows a perspective view of the gas-dynamic pressure wave machine of FIG. 1.

FIGS. 1 and 2 illustrate a gas-dynamic pressure wave machine on which a number of improvements have been effected in view of a substantial increase of the overall efficiency. Pressure wave machine 30 is connected to schematically illustrated internal combustion engine 33 by high pressure exhaust gas channel 31 and high pressure charge air channel 32 in which there is a charge air cooler 12. Gas housing 34 further accommodates low pressure exhaust gas channel 35, and it appears in FIG. 2 that the two channels, i.e. the high pressure exhaust gas channel and the low pressure exhaust gas channel, enter the gas housing on the rotor side through sector-shaped openings 36A and 37A forming respective opening edges 36 and 37. Further illustrated is rotor 40 with its cells 41, the rotor being disposed in an envelope 42 and driven by a belt drive 43, for example.

A first aim consists in adjusting the alignment of the opening edges of the high pressure exhaust gas channel with respect to the opening edges of the high pressure charge air channel in such a manner that the so-called primary wave that is generated when the high pressure exhaust gas in the high pressure exhaust gas channel reaches the location at which the high pressure exhaust gas channel opens onto the rotor cell, in which the pressure is lower, is precisely adjusted such that the primary wave arrives on the air side where the high pressure charge air channel opens onto the rotor cell at the same time that the high pressure charge air reaches the air side. In the past, it was attempted to achieve this optimization by providing the housings with rotatable disks with apertures in order to influence the two high pressure flows.

According to the present invention, the opening edges of the high pressure charge air channel 32, i.e. the openings leading to the rotor cells, are adjusted either by rotating the air housing 39 with respect to the stationary rotor and to the gas housing, or by rotating the high pressure charge air channel only. The result is that the opening edges of the two high pressure channels may be adjusted to each other in each point of the performance field of the internal combustion engine such that the primary wave fulfills the above-mentioned condition. The rotation of the housing may e.g. range from 0 to 25°.

An important increase in power may be achieved by a direct fresh air inlet to the exhaust gas channel. FIGS. 1 and 2 show connecting duct 46 leading from the high pressure charge air channel to the high pressure exhaust gas channel, through which the positive pressure pulses in the high pressure charge air channel are transmitted to the high pressure exhaust gas channel. The connecting duct comprises a nonreturn valve 47 that may be provided with an electronic control, as the case may be. The nonreturn valve provides a regulation in the sense that only pressure pulses are transmitted whose energetic level is higher than the momentary pressure in the high pressure exhaust gas channel. Thus, mainly the negative pressure pulses are raised, i.e. the condition of quasi-negative pressure in the high pressure exhaust gas channel, and the overall pressure level both inside the high pressure exhaust gas channel and inside the high pressure charge air channel increases due to the smoothing of the negative pressure pulses. This allows a significant increase of the pressure level in the rotor prior to the opening of the high pressure exhaust gas channel, and the pulsations arriving from there are dampened. Furthermore, this measure reduces the losses in the inflow of the hot exhaust gases into the rotor as the entire process is dampened.

A further improvement is obtained if the junction, which is located somewhere between the high pressure charge air channel edge and the motor inlet according to FIG. 1 or 2, is placed directly after the opening edge of the high pressure charge air channel. This preferred embodiment is not illustrated in FIG. 1 for the sake of clarity.

As mentioned before, the pressure wave machine of the prior art is very sensitive to the filling degree. In addition to the reduction of the pressure pulsations as described above, the presence of a connecting duct allows the feedback of charge air to the high pressure exhaust side of the pressure wave machine and thus an increased mass flow of the machine and consequently an increase of the filling degree, which results in a significant pressure increase. Thus, an additional regulation of the amount of recycled high pressure fresh air by means of a regulated nonreturn valve may serve in a general manner for the regulation of the charging pressure, and in a spark ignited engine additionally for the power regulation. In other words, this means that the pressure wave machine may be dimensioned a little larger for an improved compression efficiency at higher flow rates of the engine without losing charging pressure at lower flow rates of the engine.

This may also be achieved e.g. through a regulation of the cross-sectional area of the connecting channel by means of a suitable, known device. For this purpose, the regulated nonreturn valve or an additional regulation of the cross-sectional area may be used. This is particularly effective in the low to medium speed, temperature, and load range of the internal combustion engine. This means that the system for increasing the power by means of a connecting duct constitutes an auxiliary means allowing an important increase of the charging pressure making use of the exhaust gas pulsations and of the positive pressure difference across the pressure wave machine in the case of an insufficient charging pressure at low engine speeds from 1000 to 3000 RPM.

The application of a connecting duct between the fresh air section and the exhaust gas section results in a considerable increase in efficiency in otherwise known pressure wave machines, but it is particularly effective in conjunction with the measures for increasing the efficiency mentioned and described above. This power increase should be controllable by the motor control through an actuator having an open-closed function.

Figure 3:
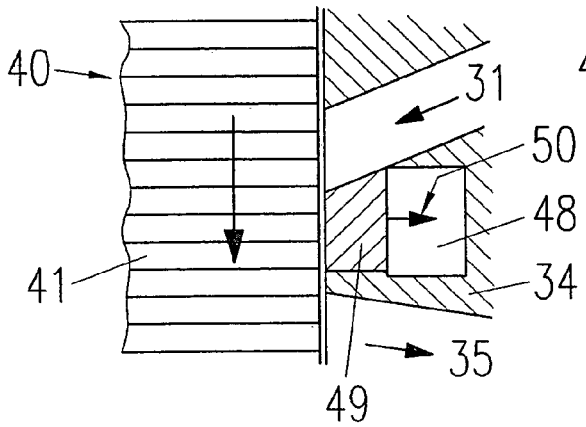
FIGS. 3, 3A schematically show a detail of a developed cylindrical section through the cells of a rotor of a pressure wave machine provided with a variable enlargement of the high pressure exhaust gas channel.
Figure 3A:
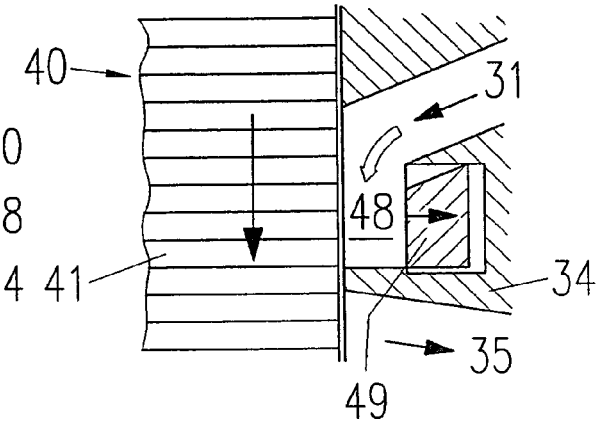

FIGS. 3 and 3A refer to another aspect of the pressure wave machine, i.e. to the action upon the high pressure exhaust flow. FIGS. 3, 3A schematically illustrate a device for influencing the high pressure exhaust channel, resp. for its enlargement. The figures show a developed view of rotor 40 with its cells 41, and gas housing 34 is provided with a recess 48 that can be varied by a slide valve 49 as indicated by arrow 50. In FIG. 3A, slide valve 49 is entirely engaged in the direction of the arrow, so that the high pressure exhaust channel is enlarged without creating a ridge. By a suitable control of the slide valve, which is calculable for those skilled in the art, the slide valve may be displaced so as to enlarge the high pressure channel in such a manner that the pressure drops until the charging pressure produced in the pressure wave process decreases to the desired level.

Analogously, unless the enlargement of the high pressure exhaust gas channel is chosen, the gas pocket inflow may be varied in a known manner, although it is less effective since a ridge will remain in this case.

As mentioned in the introduction, a number of possible error sources are known which may disturb the operation of the internal combustion engine or damage the gas-dynamic pressure wave machine. Therefore, it is useful to follow a certain sequence in the control of a pressure wave supercharger in each area of the performance field of the internal combustion engine.

This means that the respective positioning as well as a sequence in the actuation of the involved actuating members might be described for each point of the performance field. However, since this would result in an endless enumeration, two possible adjustments will be chosen: when the power of the internal combustion engine is increased, or in simple terms when the throttle is opened, and when the throttle is closed or when the speed is reduced.

Herebelow, an example of the control during a positive load variation is indicated, i.e. when the throttle is opened, the throttle of the internal combustion engine or the control rod in a diesel engine being opened by being displaced by a cable control or an electric actuator according to the demand of the driver for more power.

1. At the beginning of the load variation, scavenging air flap 59, see FIG. 1, located in the inlet channel in front of the pressure wave machine, must immediately be opened as far as possible by suitable means, e.g. by the electric actuator or the cable control, in order to ensure the increased air flow through the pressure wave machine.
2. The operating speed and the rotation of the housing of the pressure wave machine, especially of air housing 39, must be moved by suitable means to the optimum position as stored in the performance field in relation to the actual point of the performance field.
3. The slide valve 49 of the variable width adjustment of the high pressure exhaust gas channel or of the variable gas pocket inlet must be brought to the position stored in the performance field by being adjusted for the charging pressure required by the performance field of the engine.
4. The valve of connecting duct 46 between the high pressure charge air channel and the high pressure exhaust gas channel may additionally be opened if the required charging pressure is not attained, preferably only between $N_{eng}$=1000–3000 r/min.
5. The variable width adjustment of the high pressure exhaust gas channel or the variable gas pocket inlet will subsequently take over the function of regulating the pressure according to the driver's request.

It will be noted here that the nonreturn valve of the connecting duct may only be opened when all other parameters and actuating members have already reached their optimum positions after the positive load variation in order to fulfill the requirement of the highest possible charging pressure. This is necessary as the power increasing system intensifies the high pressure process at the expense of the scavenging process.

In the control of the pressure wave machine during a negative load variation, i.e. while reducing the speed, with subsequent part load behavior, the following sequence should be followed:

1. In a negative load variation, requiring a reduced charging pressure, the connecting duct must be closed first and immediately. It must be guaranteed that the valve of the connecting duct is closed.
2. Regarding the rotation of the housing and the adjustment of the operating speed of the pressure wave machine, these parameters should assume an optimum position as established in the motor test and stored in the performance field.
3. Scavenging air flap 59 of the pressure wave machine should be closed as far as possible without causing a collapse of the rotor scavenging. This requires sensors at the λ-probe and a measurement of the exhaust gas temperature downstream of the pressure wave machine.
4. The slide valve of the variable width adjustment of the high pressure exhaust gas channel or of the variable gas pocket inlet should be open as wide as possible, so that the pressure difference between the high pressure charge air and the high pressure exhaust gas is minimum.

Tests have shown that optimum power and low consumption are attained if the described order in the control of the pressure wave machine is followed.

As already mentioned, a positioning and a sequence in the operation of the involved actuating members might be described for each point of the performance field. However, as this would result in an endless enumeration, it is useful to start from the principle of the optimum positioning and of a subsequent control e.g. by means of PID controllers.

The rotation of the housing, the operating speed, and the position of the slide valve in the width adjustment of the high pressure exhaust gas channel or of the variable gas pocket inlet may vary according to the actual requirement, and different adjustments thereof may yield similar results. Good results are obtained by optimizing the power and the torque of the internal combustion engine while adjusting the pressure wave machine.

As mentioned in the introduction, the present application particularly refers to the control of the operations in a positive and a negative load variation, but it is understood that the mentioned other three phases in constant driving will also be optimized by providing a certain control sequence. Subsequently, the control in these three partial phases will be combined with the remaining control steps effected in the prescribed order.

The method of the invention is not limited to the described system formed of an internal combustion engine and a pressure wave machine. In its basic form, the method is valid for all systems combining an internal combustion engine and a pressure wave machine. Its best efficiency is achieved if all options are included. Also, the method applies both to spark ignited engines and to diesel engines with or without catalysts and with or without additional heating systems.

What is claimed is:

1. A method for the control of an internal combustion engine combined with a gas-dynamic pressure wave machine, said gas-dynamic pressure wave machine comprising a rotatable housing in order to regulate the process tuning over the entire performance field of the internal combustion engine, as well as a variable width adjustment of the high pressure exhaust gas channel or a variable gas pocket said method, in a positive load variation, comprising the following steps in the order named:

the operating speed and the rotation of the housing of the gas-dynamic pressure wave machine being adjusted by suitable means to the optimum position as stored in the performance field, and the variable width adjustment of the high pressure exhaust gas channel or the variable gas pocket inlet being adjusted for the charging pressure required according to the performance field of the engine; and said method, in a negative load variation, comprising the following steps in the order named:

the operating speed and the rotation of the housing of the gas-dynamic pressure wave machine being adjusted by suitable means to the optimum position as stored in the performance field, and the variable width adjustment of the high pressure exhaust gas channel or the variable gas pocket inlet being opened as far as possible in order to keep the pressure difference between the high pressure charge air and the high pressure exhaust gas as low as possible.

2. The method of claim 1, wherein the rotatable housing of the gas-dynamic pressure wave machine is the air housing.

3. The method of claim 1 in a negative load variation, wherein it is ensured that a connecting duct provided between the high pressure charge air channel and the high pressure exhaust gas channel is certainly closed.

4. The method of claim 3, wherein a valve in said connecting duct is actuated by the control of the internal combustion engine through an actuating member.

5. The method of claim 3, wherein at the beginning of the negative load variation, the scavenging air flap is closed as far as possible without causing a collapse of the rotor scavenging.

6. The method of claim 1, wherein at the beginning of the positive load variation, while the control element of the internal combustion engine is displaced in accordance with the driver's demand for more power, a scavenging air flap in the intake channel of the gas-dynamic pressure wave machine is opened as far as possible.

7. The method of claim 6, wherein a connecting duct between the high pressure charge air channel and the high pressure exhaust gas channel is additionally opened in a positive load variation if the required charging pressure is not attained.

8. The method of claim 7, wherein said opening is affected in a range of $N_{eng}$=1000–3000 r/min.

9. The method of claim 7, wherein said opening is only affected when all other parameters and actuating members are already in their optimum positions after the positive load variation.

* * * * *